United States Patent [19]

Josephs

[11] Patent Number: 4,854,460

[45] Date of Patent: Aug. 8, 1989

[54] PORTABLE STORAGE CONTAINER WITH INTEGRAL RAMP

[75] Inventor: Charles R. Josephs, Fort Worth, Tex.

[73] Assignee: Rent-A-Vault, Inc., Fort Worth, Tex.

[21] Appl. No.: 155,305

[22] Filed: Feb. 12, 1988

[51] Int. Cl.[4] ..... B65D 19/00

[52] U.S. Cl. ..... 220/1.5

[58] Field of Search ..... 220/1.5; 296/24 C, 57 R, 296/61, 181, 182, 183, 24.2; 105/355; 119/7

[56] References Cited

U.S. PATENT DOCUMENTS

| | | | |
|---|---|---|---|
| 1,740,000 | 12/1929 | Andrews et al. | 220/1.5 |
| 2,621,070 | 12/1952 | Crivella | 296/24.2 |
| 2,653,845 | 9/1953 | Benjamin | 296/61 |
| 3,053,224 | 9/1962 | Pierce | 296/24 C X |
| 3,756,440 | 9/1973 | Raap et al. | 296/61 X |
| 3,841,516 | 10/1974 | März | 220/334 X |
| 3,972,437 | 8/1976 | Lovich et al. | 220/1.5 |
| 4,295,431 | 10/1981 | Stavlo | 220/1.5 X |

*Primary Examiner*—Steven M. Pollard

*Attorney, Agent, or Firm*—Daniel V. Thompson

[57] ABSTRACT

A portable storage container is provided wherein walls define a rectangular oblong box closed at one end and open at the other end. At least one door is hingedly connected to at least one of the edges of the open end for movement between a closed position and an open position. A ramp is hingedly connected to the open end for the movement between a stowed, upright position and lowered position.

8 Claims, 8 Drawing Sheets

PORTABLE STORAGE CONTAINER WITH INTEGRAL RAMP

FIELD OF THE INVENTION

The present invention relates to portable storage containers, and more particularly to a portable storage container having an integral ramp.

BACKGROUND OF THE INVENTION

At various times construction companies, retailers, schools and other organizations require temporary but secure storage space. For example, a construction contractor may need to store building materials such as plumbing fixtures when they arrive at a construction site at a time prior to the contractor's ability to install the same. Similarly, a retailer might receive excess inventory that exceeds its normal warehouse space but which needs to be temporarily stored adjacent to the retail facility. A school may have need for temporary storage of books and other materials. Satisfying demans for temporary space by providing portable storage containers obviates the need for many consumers to build additional permanent storage facilities or lease storage facilities away from the main site. Thus, there presently exists a need for secure, convenient, economical and, above all, portable storage space.

SUMMARY OF THE INVENTION

The present invention provides a portable storage container that satisfies the need for secure and portable storage space. The storage container includes walls defining a rectangular oblong box closed at one end and open at the other end, a pair of doors hingedly conected to the open end, and a loading ramp at ground level for safe loading and unloading using hand carts or forklifts. The container is constructed entirely of steel, thus ensuring a well protected temporary area for expensive materials, equipment, tools and the like.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Figure 1:
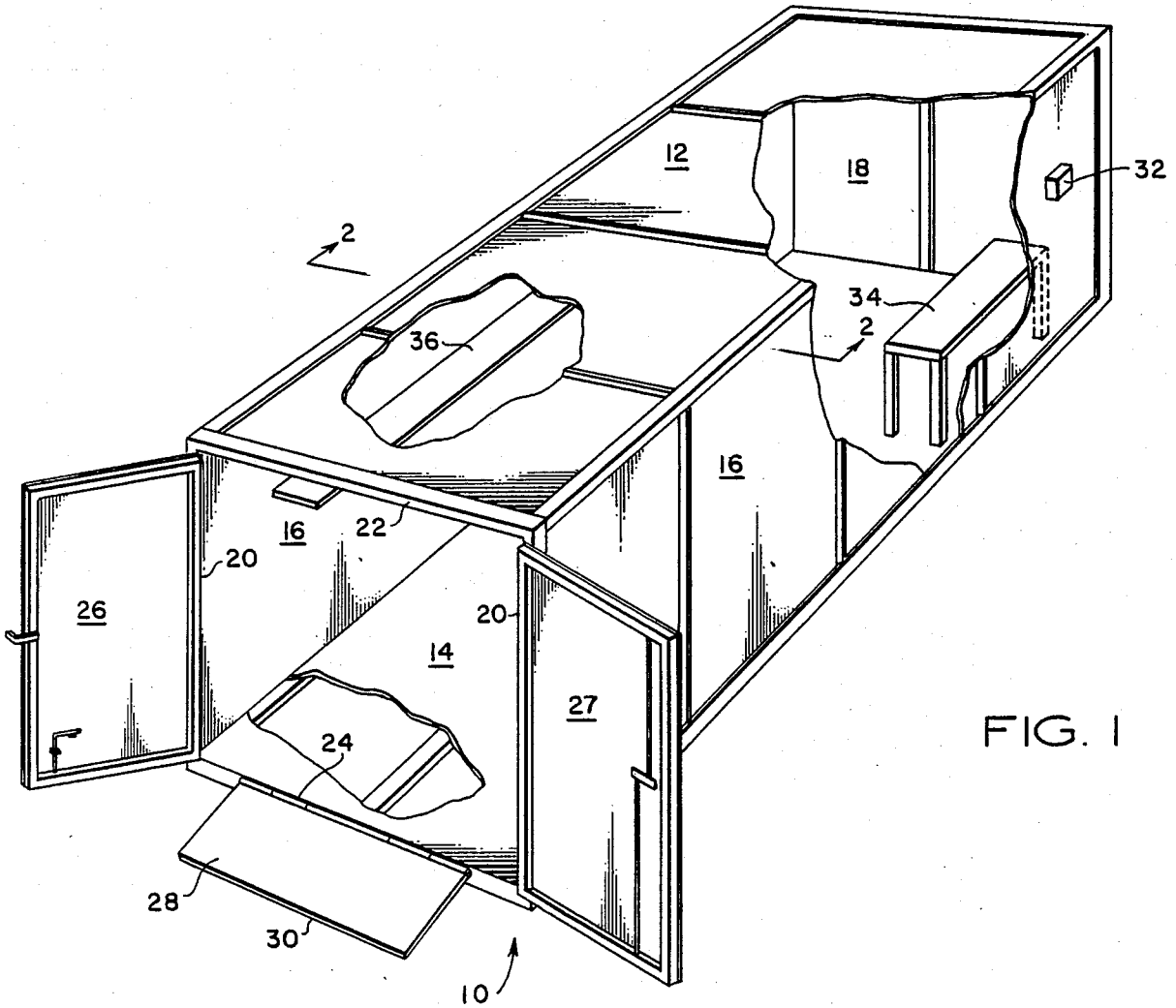
FIG. 1 is a partially broken away perspective view of a portable storage container constructed in accordance with the invention.

Referring initially to FIG. 1, portable storage container 10 includes top wall 12, bottom wall 14, and side walls 16. In the preferred embodiment, container 10 is closed at end 18 and has an opening at the other end defined by two side edges, 20 an upper edge 22 and a lower edge 24. A pair of doors 26 and 27 are hingedly connected to side edges 20. Each of doors 26 and 27 is openable about a vertical axis, and doors 26 and 27 are of susbstantially equal width. A key feature of the invention resides in the provision of ramp 28, which is hingedly connected to lower edge 24 for movement between a stowed, upright position substantially adjacent doors 26 and 27 when closed and a lowered position, as shown in FIG. 1, where outer edge 30 of ramp 28 is substantially adjacent to the surface upon which container 10 rests.

The preferred embodiment of container 10 provides 1280 cubic feet of storage, with the opening defined by edges 20, 22 and 24 being 8 feet wide and 8 feet high. Container 10 has a longitudinal length of 20 feet. Preferably, an electrical outlet 32 is provided to power equipment and lights within the container. In addition, foldaway workbench 34 and shelf 36 may be provided.

Figure 2:
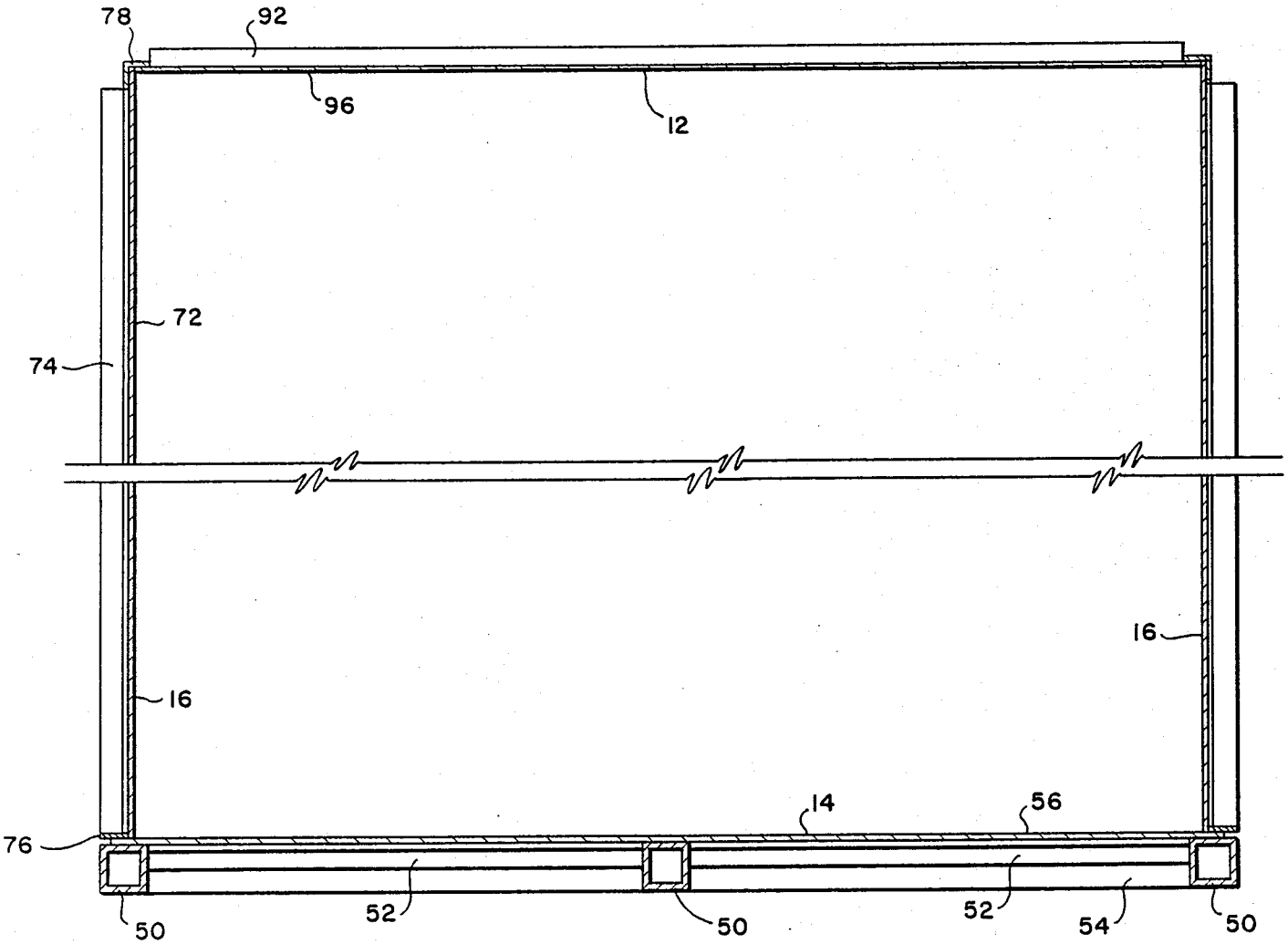
FIG. 2 is a sectional view taken along lines 2—2 of FIG. 1.
Figure 3:
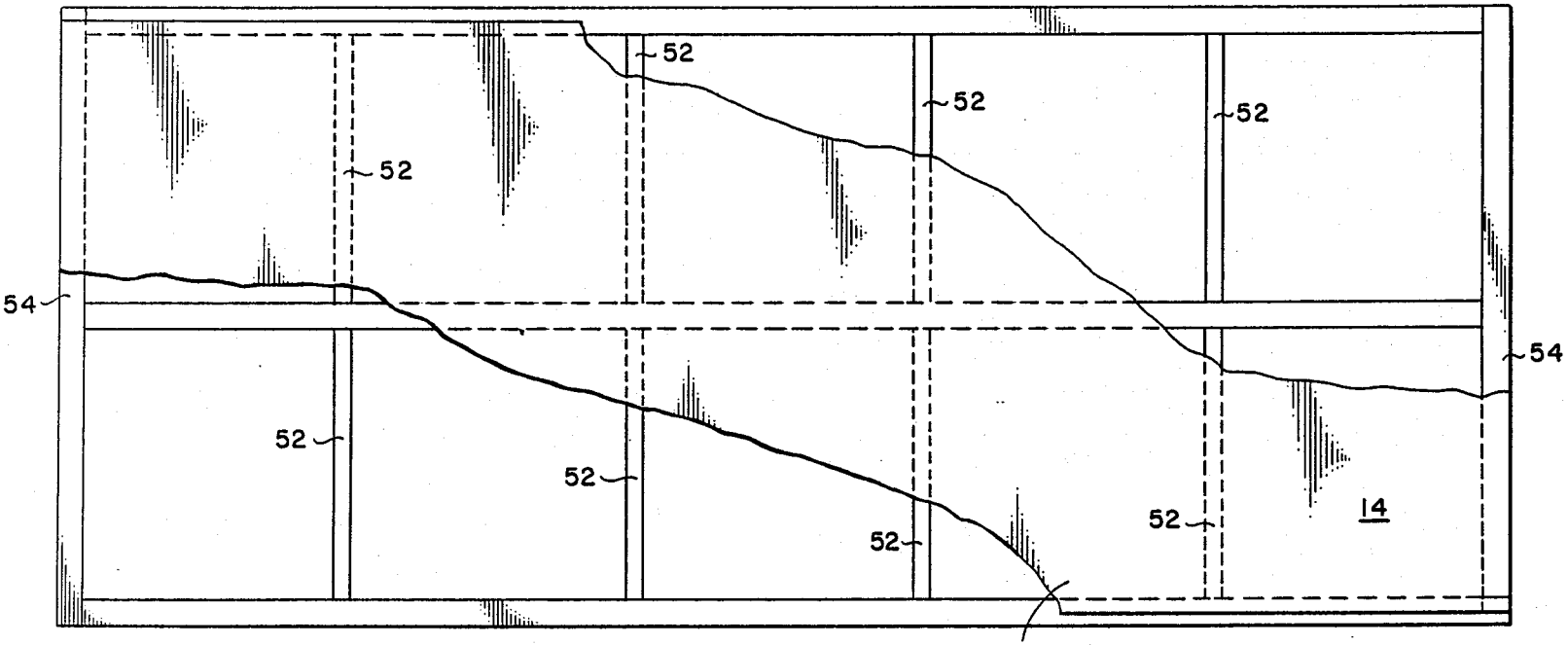
FIG. 3 is a partially broken away overhead view of the bottom wall of the container in FIG. 1.
Figure 4:
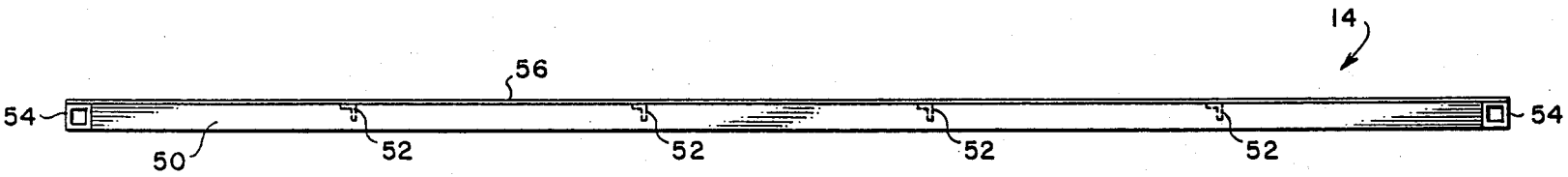
FIG. 4 is a side view of the bottom wall of FIG. 3.

Referring now to FIGS. 2, 3, 4, 5, 6, 6A, 7, 8, the structural details of the container 10 can be readily appreciated. As shown in FIGS. 2, 3 and 4, the bottom wall 14 is constructed in a highly reinforced manner in order to support heavy loads and includes three longitudinal members 50, with two members 50 along the sides of bottom wall 14 and a third member 50 along the center of bottom wall 14. Lateral members 52 extend between the longitudinal members 50 and are spaced approximately four feet apart. Preferably, longitudinal members 50 are formed from $4''\times4''\times\frac{1}{4}''$ square steel tubing, while lateral members 52 are formed from $2''\times2''\times\frac{1}{4}''$ steel angle. End lateral members 54 are welded to the longitudinal members 50 and are formed by a $4''\times4''\times\frac{1}{4}''$ square steel tubing, as are the longitudinal members 50. Floor 56 overlays the members 50, 52, and 54 and is formed of 3/16" steel plate.

Figure 5:
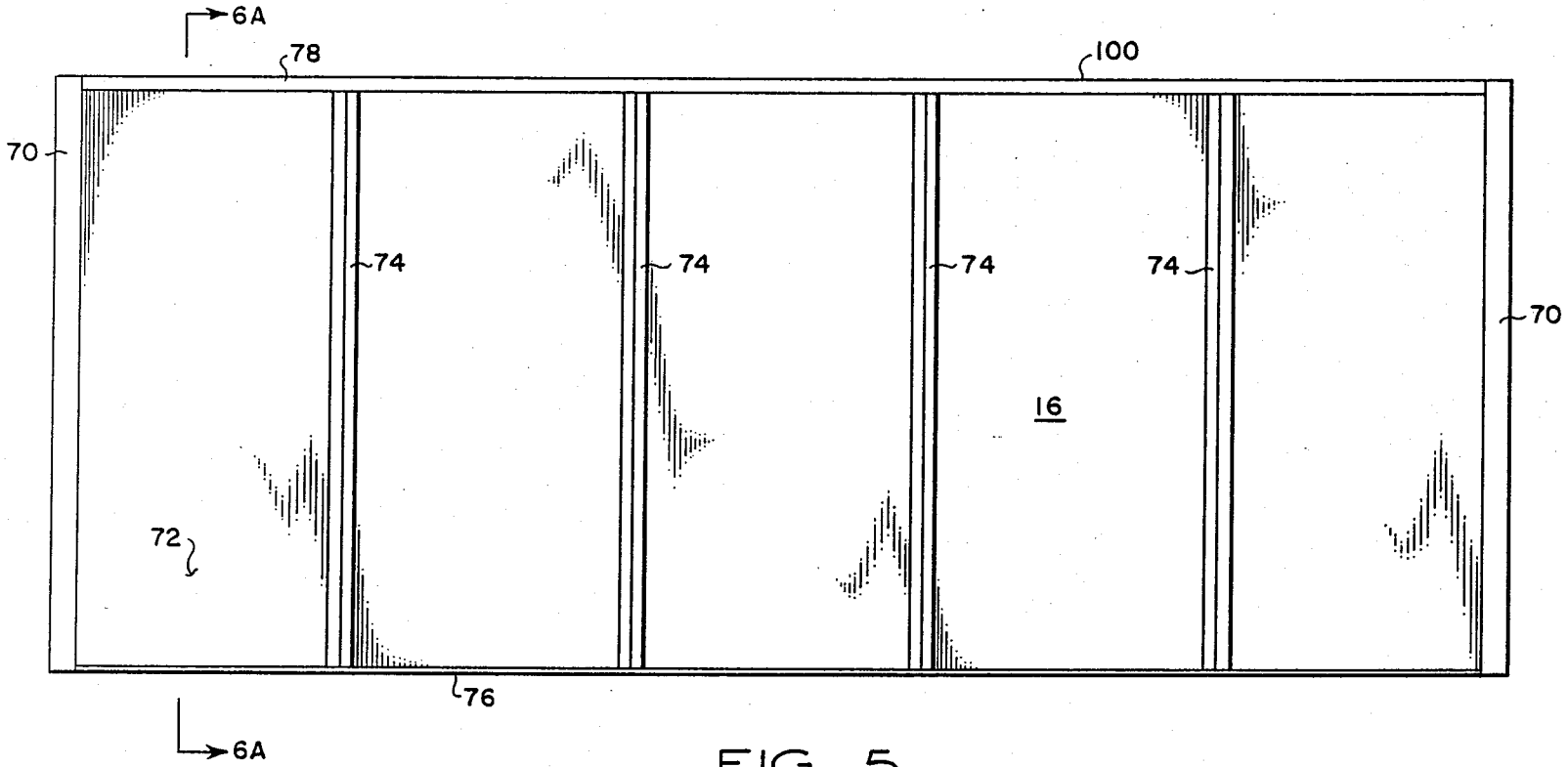
FIG. 5 is a side view of the side wall of the container in FIG. 1.
Figure 6:
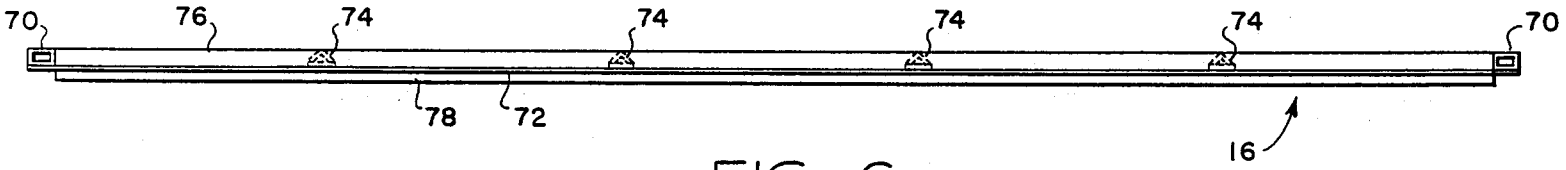
FIG. 6 is an overhead view of the side wall of FIG. 5.
Figure 6A:
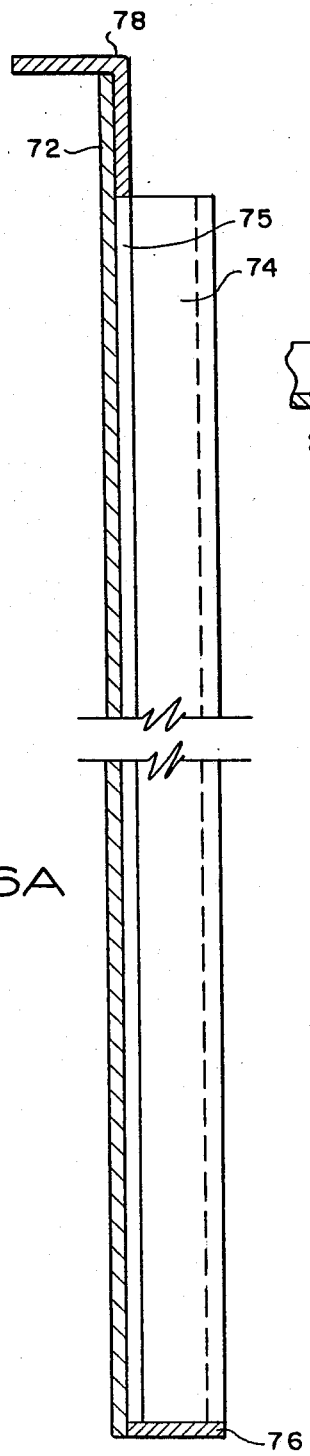
FIG. 6A is a fragmentary sectional view taken along lines 6A—6A of FIG. 5.

The side walls 16, as illustrated in FIGS. 2, 5 and 6, include end upright members 70 formed of 4p41 $\times2''\times\frac{1}{4}''$ rectangular steel tubing. Twelve gauge steel plate 72 extends between end upright members 70 to form the side wall, and is stiffened by intermediate upright members 74, which are formed by $2''\times2''\times\frac{1}{4}''$ angle steel. Bottom members 76 are formed from $2''\times\frac{1}{4}''$ flat steel, and top members 78 are formed by $2''\times2''\times\frac{1}{4}''$ angle steel. The horizontal portions of top members 78 extend inwardly.

Figure 7:
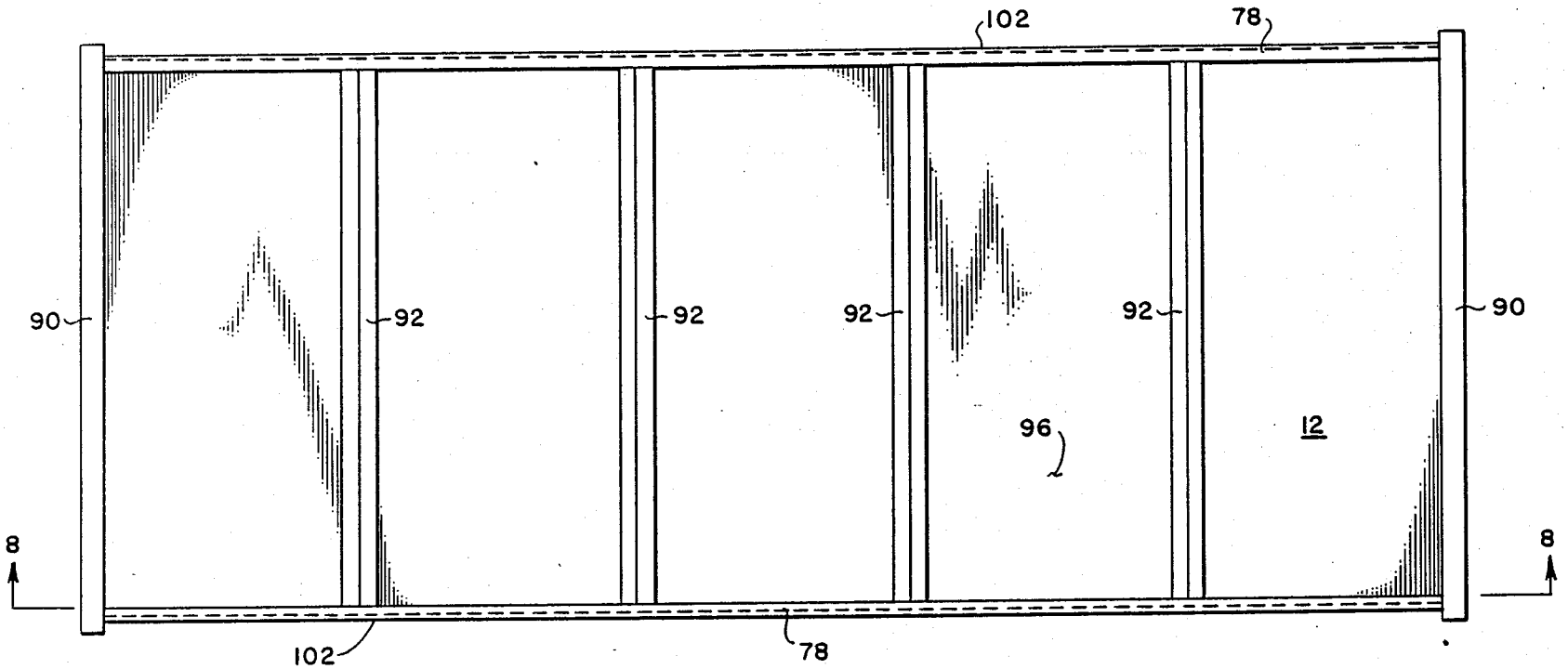
FIG. 7 is an overhead view of the top wall of the container in FIG. 1.
Figure 8:
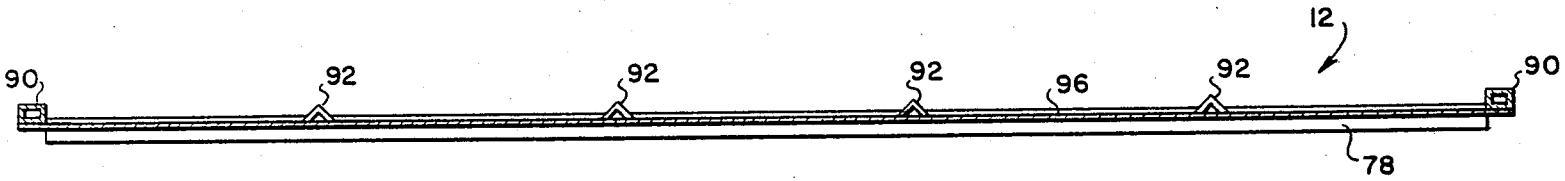
FIG. 8 is a side view of the top wall of FIG. 7.

Referring now to FIGS. 2, 7 and 8, top wall 12 includes end lateral members 90 and intermediate lateral members 92. In preferred form, end lateral members 90 are formed of $4''\times2''\times\frac{1}{4}''$ rectangular tubing, while intermediate lateral members 92 are formed from $2''\times2''\times\frac{1}{4}''$ angle steel. Twelve gauge steel plate 96 forms the top wall.

As can be seen by taking FIGS. 2, 5, 6, 6A, 7 and 8 together, the intermediate members 74 and 92 terminate inwardly from the top edges 100 of side wall 16 and the side edges 102 of top wall 12. This enables angle steel top members 78 to extend along the top side edges of the container 10. In addition, the end portions of end lateral members 90 of top wall 12 extend outwardly from member 78, as shown in FIG. 7. This enables end lateral members 90 to interlock with members 54 and 70 to provide a smooth outer perimeter of container 10. All of the joints between the members and steel plate are welded, such that a weather-tight construction is provided.

Figure 10:
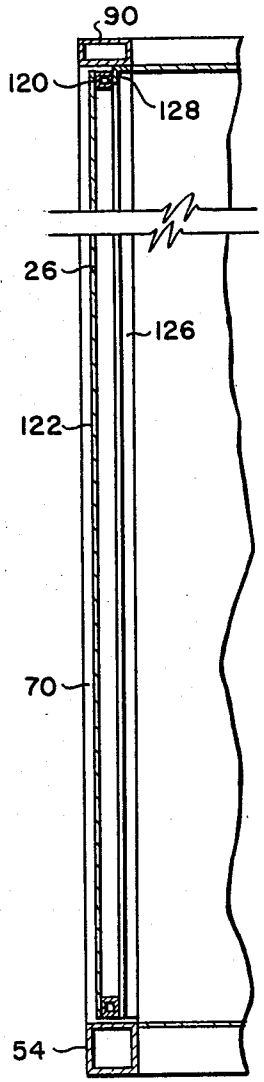
FIG. 10 is a sectional view taken along lines 10—10 of FIG. 9.
Figure 9:
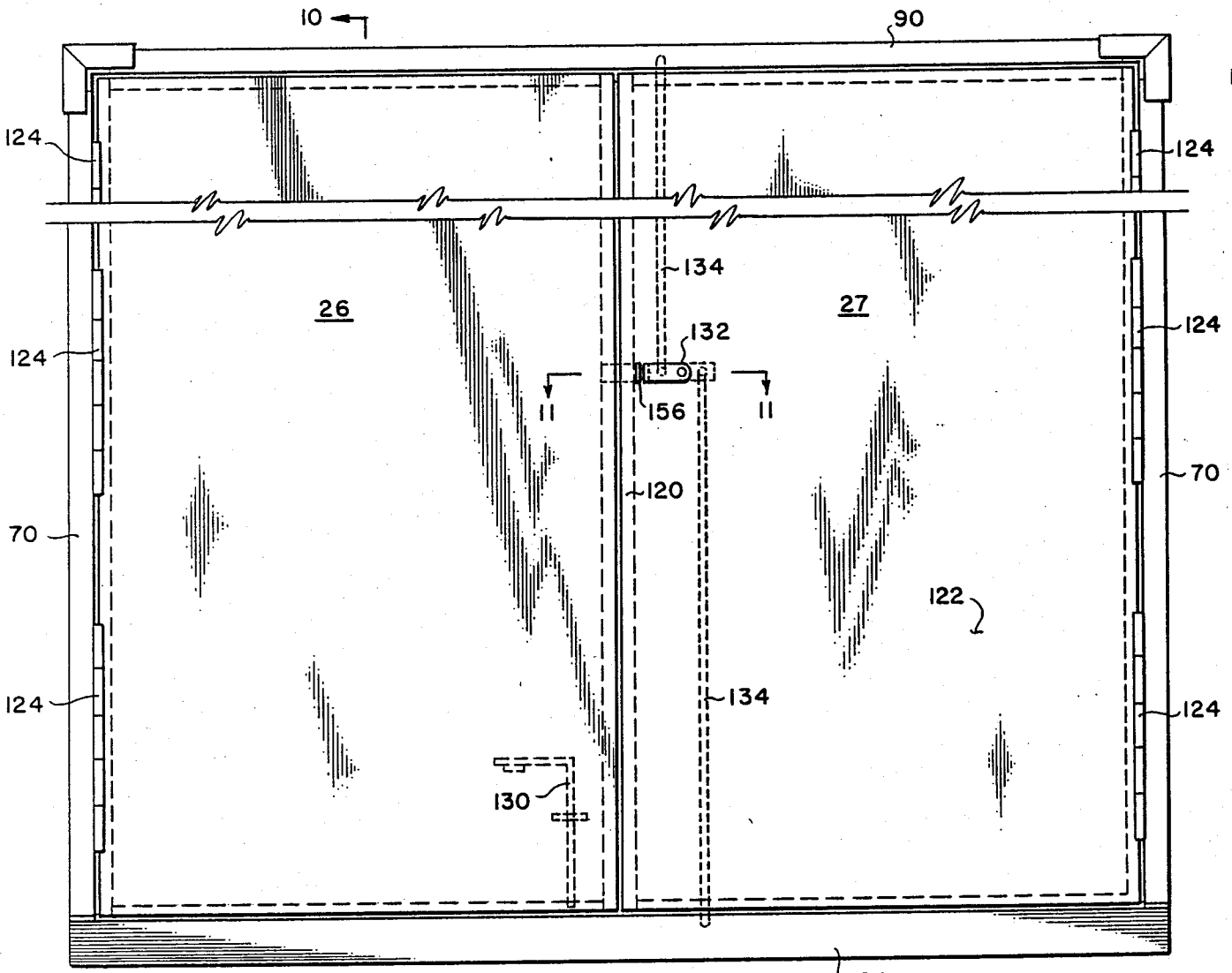
FIG. 9 is an end view of the container with the ramp and lock guard structure removed to illustrate the door structure.

Referring now to FIGS. 9 and 10, each of the doors 26 and 27 includes a rectangular frame 120 formed of 1"×1" square tubing around the perimeter thereof and twelve gauge steel plate member 122. Hinges 124 hingedly interconnect the sides of frames 120 with members 70. Vertical door jamb members 126 are welded to members 70 inside doors 26 and 27 and horizontal door jamb member 128 is welded in similar fashion to member 90. Preferably, door jamb members 126 and 128 are formed by 1"×1"×⅛" angle steel. An inside locking bar 130 is provided to lock door 26 in the closed position. The other door 27 includes a combination door hasp/handle 132 pivotally mounted to actuate upper and lower lock bars 134. Bars 130 and 134 engage registered openings in adjacent members 54 or 90, as the case may be, to lock the doors.

Figure 11:
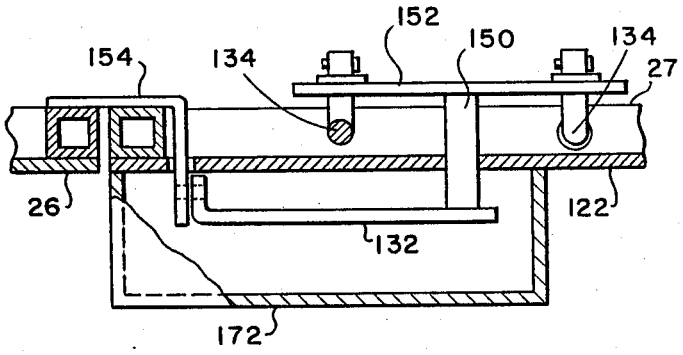
FIG. 11 is an enlarged sectional view taken along lines 11—11 of FIG. 9.
Figure 12:
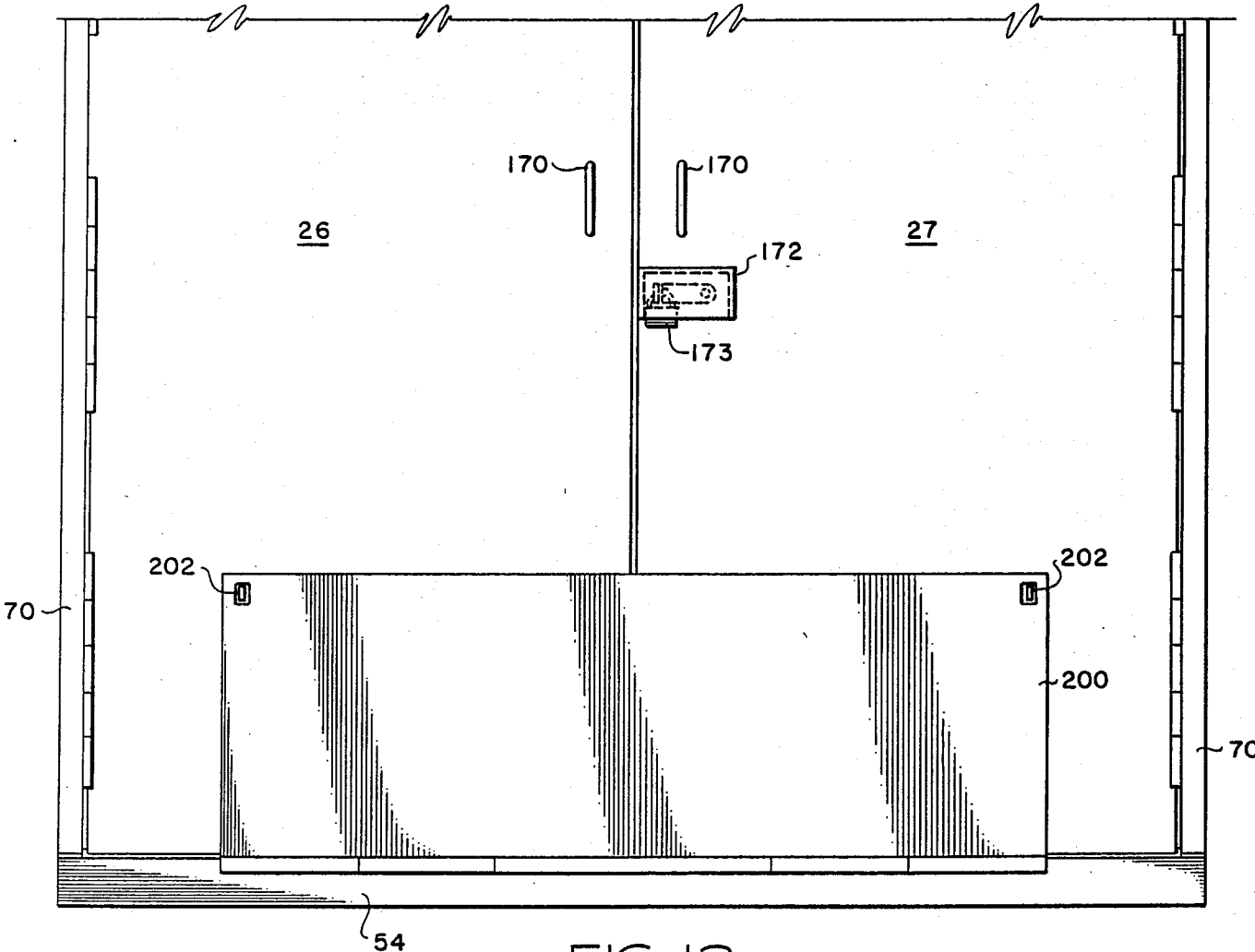
FIG. 12 is a fragmentary end view of the container of FIG. 1 with a lock guard and ramp structure attached.

As shown in FIGS. 11 and 12, hasp/handle 132 is pivotally mounted to door 27 by way of pivot pin 150 which extends through a hole in plate member 122. A bar 152 is welded to pivot pin 150 inside door 27 to pivotally engage lock bars 134. To release lock bars 134 from their corresponding registered holes, hasp/handle 132 is rotated downwardly. A section of angle steel is provided as member 154 welded to the frame 120 of the other door 26 and extending outwardly through slot 156. Member 154 includes an aperture which registers with an aperture in handle/hasp 132 to enable a padlock to be used to lock the doors in the closed position, as shown in FIG. 12.

Figure 13:
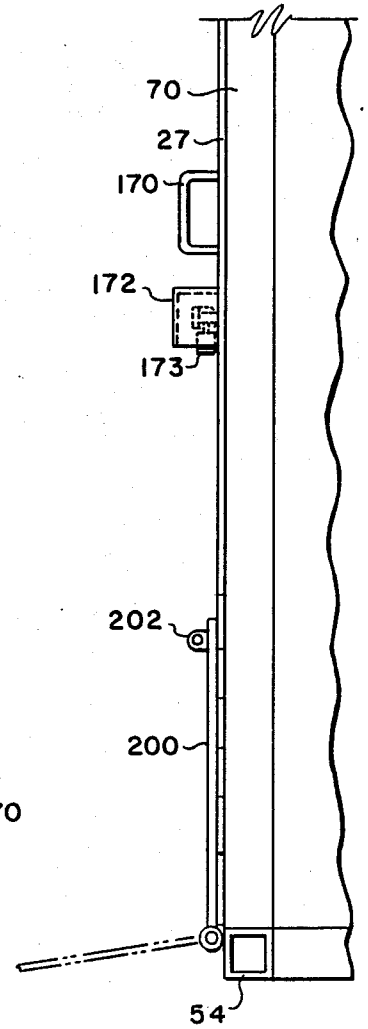
FIG. 13 is an fragmentary side view of the portion of the container shown in FIG. 12.

Referring now to FIGS. 12 and 13, grips 170 are provided on each of the doors 26 and 27. A lock guard 172 is provided over the handle/hasp 132 and member 154. A padlock 174 is shown in engagement with element 154 and handle/hasp 132. Ramp 200 is hingedly connected to end lateral member 54. Preferably, ramp 200 is formed from ⅜" checkered steel plate and is openable as shown between a stowed, upright position adjacent doors 26 and 27 when closed as shown in FIGS. 12 and 13 and a lowered position, as shown in FIG. 13 in dotted lines. When in its lowered position, the ramp 200 is substantially flush with the floor 56 to enable the use of forklifts, hand trucks and the like to load/unload the container. Feet 202 are provided at the outer corners of ramp 200. Preferably the hinge connection between ramp 200 and member 54 is formed from 1¼ pipe sections welded to ramp 200 and member 54 in an interlocking fashion, with one inch pipe serving as a hinge pin.

In operation, construction companies, retailers, schools and the like may use containers 10 for secure and economical stoarge of equipment, tools, inventories and records. Users can thus save on insurance, retard theft and reduce loss of time with convenient storage containers 10 on or near the work site. Container 10 sits at ground level, with its own self-contained, skid-proof ramp 200. Ramp 200 easily supports rolling carts and heavy forklifts, as does the reinforced floor of container 10. The all-steel, weather-tight construction with welded seams and recessed, overlapping doors 26 and 27 protect the contents of containers 10 from rain, wind and dust. Lock guard 72 safeguards against lock cutters and other entry devices, adding security to doors 26 and 27.

What is claimed is:

1. A portable storge container, comprising:

a plurality of walls, including a top wall, a bottom wall, two side walls and an end wall, said walls defining an oblong, rectilinear, unitary enclosure having two rectangular ends, with said enclosure being closed at one said end and open at the other said end, and said enclosure being freely supported on an underlying stationary surface by said bottom wall;

said open end being defined by horizontal upper and lower edges and two vertical side edges;

a pair of rectangular doors hingedly connected to said side edges such that said doors are pivotable about vertical axes between open and closed positions, said doors being of substantially equal width and height;

said doors in said closed position having upper edges closely spaced with said upper edge of said open end, lower edges closely spaced with said lower edge of said open end, outer edges closely spaced with said side edges of said open end, and inner edges closely spaced to one another, such that said doors substantially entirely seal said open end when in their said closed positions; and a rectangular ramp hingedly connected to said lower edge of said open end for movements between a stowed, upright position and a lowered position, said ramp in said raised position being substantially adjacent to and supported by said doors when in their said closed positions, and said ramp having an outer edge being substantially adjacent to said stationary surface when said ramp is in said lowered position wherein the inner edge of the ramp is substantially flush with an inner floor surface of the container when the ramp is in its lower position; further comprising means for locking the doors in their closed position; said locking means includes outside lock means for locking and unlocking a first one of said two doors to be enclosure from the exterior thereof and inside lock means operable from the interior of said enclosure for locking and unlocking the second one of said doors to said enclosure from the interior thereof; said outside lock means inludes at least a first lock bar slidably mounted to the interior of said first door for movements between extended and retracted positions, and walls defining an opening in said enclosure registered with said lock bar for receiving said first lock bar in its said extended position, and a handle movably mounted to the exterior of said first door and connected to said first lock bar is movable between said extended and said retracted positions by movement of said handle; and means for guarding the means for locking, said means for guarding including a partial enclosure for the means for locking fixed to an external surface of one of the doors.

2. The portable storage container of claim 1 wherein said outside lock means includes a pivot pin fixed to said handle and extending through walls defining a hole in said first door, said handle being rotatable about said pivot pin, and an arm fixed to said first lock bar such that said first lock bar is movable between said extended and said retracted positions by rotation of said handle.

3. The portable storage container of claim 2 wherein said handle includes walls defining an aperture therein, and said outside lock means includes a member fixed to said second door having walls defining an aperture in said member registered with said aperture in said handle when said doors are in their said closed positions, and said apertures being sized to receive a padlock.

4. The portable storage container of claim 3 wherein said member is fixed to an interior edge of said second door and extends through walls defining a slot in said first door.

5. The portable storage container of claim 3 further comprising lock guard means partially enclosing said outside lock means for protecting said outside lock means.

6. The portable storage container of claim 1 wherein said inside lock means includes a second lock bar slidably mounted to sid second door for movements between extended and retracted positions, and walls defining an opening in said enclosure registered with said second lock bar for receiving said second lock bar in its said extended position.

7. The portable storage container of claim 1 wherein said doors are recessed into said enclosure in their said closed positions.

8. The portable storage container of claim 7 further comprising a horizontal door jamb member fixed to said upper edge of said open end and two vertical door jamb members fixed to said two side edges of said open end, said door jamb members being located such that said doors butt against said door jamb members when said doors are in their said closed positions.

* * * * *